US009966678B2

(12) United States Patent
Chiang et al.

(10) Patent No.: US 9,966,678 B2
(45) Date of Patent: May 8, 2018

(54) NEXT GENERATION FORM FACTOR CONNECTOR

(71) Applicant: HEWLETT PACKARD ENTERPRISE DEVELOPMENT LP, Houston, TX (US)

(72) Inventors: Chin-Lung Chiang, Taipei (TW); Jyun-Jie Wang, Taipei (TW); Meng-Chen Wu, Taipei (TW); Raghavan V Venugopal, Spring, TX (US); Patrick Raymond, Houston, TX (US); Andrew Potter, Houston, TX (US)

(73) Assignee: HEWLETT PACKARD ENTERPRISE DEVELOPMENT LP, Houston, TX (US)

( * ) Notice: Subject to any disclaimer, the term of this patent is extended or adjusted under 35 U.S.C. 154(b) by 0 days. days.

(21) Appl. No.: 15/329,474

(22) PCT Filed: Jul. 31, 2014

(86) PCT No.: PCT/US2014/049109

§ 371 (c)(1),
(2) Date: Jan. 26, 2017

(87) PCT Pub. No.: WO2016/018356

PCT Pub. Date: Feb. 4, 2016

(65) Prior Publication Data

US 2017/0214162 A1 Jul. 27, 2017

(51) Int. Cl.
*H01R 12/00* (2006.01)
*H01R 12/72* (2011.01)
(Continued)

(52) U.S. Cl.
CPC ..... *H01R 12/721* (2013.01); *H01R 12/716* (2013.01); *H01R 13/2457* (2013.01)

(58) Field of Classification Search
CPC ..... H01R 12/721; H01R 12/716; H01R 13/2457; G06F 13/409
(Continued)

(56) References Cited

U.S. PATENT DOCUMENTS 4,697,858 A * 10/1987 Balakrishnan ..... G06F 13/409 361/788
9,160,091 B2 * 10/2015 Tsai ..... H01R 12/716
(Continued)

FOREIGN PATENT DOCUMENTS

CN 103327656 9/2013
CN 13401084 11/2013
(Continued)

OTHER PUBLICATIONS

PCT/ISA/KR, International Search Report dated Apr. 30, 2015 11 pps. PCT/US2014/049109.
(Continued)

*Primary Examiner* — Jean F Duverne
(74) *Attorney, Agent, or Firm* — Brooks, Cameron & Huebsch, PLLC

(57) ABSTRACT

A Next Generation Form Factor (NGFF) connector apparatus can include a plurality of upper signal pins and an upper ground (GND) pin that is longer than other upper pins. The NGFF connector apparatus can also include a plurality of lower signal pins and a lower power (PWR) pin that is longer than other lower pins.

15 Claims, 4 Drawing Sheets

(51) Int. Cl.
*H01R 12/71* (2011.01)
*H01R 13/24* (2006.01)

(58) Field of Classification Search
USPC ..... 439/62
See application file for complete search history.

(56) References Cited

U.S. PATENT DOCUMENTS

| | | | |
|---|---|---|---|
| 2010/0110056 | A1 | 5/2010 | Kim |
| 2014/0122767 | A1 | 5/2014 | Hershko et al. |
| 2014/0148060 | A1 | 5/2014 | Li |

FOREIGN PATENT DOCUMENTS

| | | |
|---|---|---|
| CN | 203386934 | 1/2014 |
| CN | 203423276 | 2/2014 |
| CN | 203491412 | 3/2014 |
| KR | 1020030074133 | 9/2003 |
| KR | 1020070021991 | 2/2007 |
| KR | 1020100048200 | 5/2010 |
| TW | M482178 | 7/2014 |

OTHER PUBLICATIONS

Smith, Kent., "Understanding the PCIe interface and how it benefits solid state storage", Retrieved from blog.Isi.com/tag/m-2/, Mar. 12, 2014, 5 pages.

* cited by examiner

NEXT GENERATION FORM FACTOR CONNECTOR

BACKGROUND

Connectors can be used to connect electronic components (e.g., server components, printed circuit boards, memory modules, etc.) within servers in a computing system or network to one another. Multiple portions (e.g., terminals) of the connector may be connected to an electronic component. The connector can transmit information (e.g., a signal) between the electronic components.

DETAILED DESCRIPTION

Figure 1:
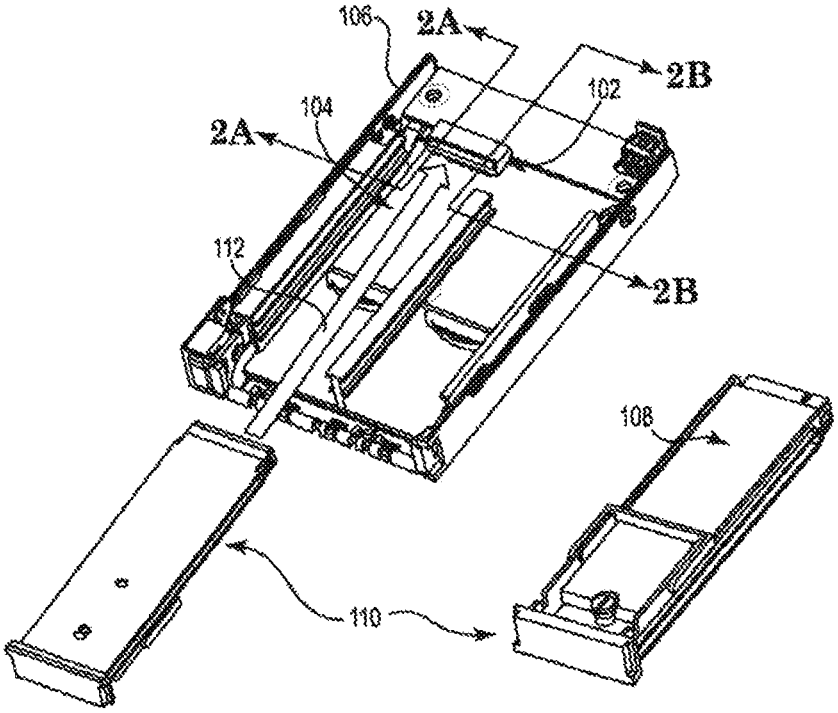
FIG. 1 illustrates a diagram of an example of an apparatus according to the present disclosure.

A Next Generation Form Factor (NGFF) connector apparatus can include a plurality of upper signal pins and a plurality of upper ground (GND) pins. The GND pins are longer than other upper pins. The NGFF connector apparatus can also include a plurality of lower signal pins and a plurality of lower power (PWR) pins. The PWR pins are longer than other lower pins. Providing upper GND pins that are longer than other upper pins and lower PWR pins that are longer than other lower pins can enable an NGFF module to be removably connected (e.g., hot-plugged) to the NGFF connector without halting the function of the NGFF connector and/or an associated computing device.

Making all upper pins a same length and all lower pins a same length may preclude the ability to hot-plug an NGFF module to an NGFF connector. This is due to the fact that the connections between the upper pins, the lower pins, and the NGFF module may be made simultaneously when the upper pins are the same length and/or the lower pins are the same length. Connecting the upper pins, the lower pins, and the NGFF module simultaneously does not allow the NGFF module to be hot-plugged into the NGFF connector.

Furthermore, offsetting the upper point of contact and the lower point of contact along a cross sectional view of the NGFF connector may require the tilting and/or rotating of the NGFF module as the NGFF module is inserted in the NGFF connector relative to a plane of the NGFF connector. For example, an NGFF module can be inserted in the NGFF connector by tilting the NGFF module twenty five degrees as the NGFF module is inserted in the NGFF connector. The twenty five degrees can be relative to the plane associated with the NGFF connector and the plane associated with the NGFF module. A plane associated with the NGFF connector can be defined by the orientation of the upper and/or lower pins that are incorporated in the NGFF connector.

In contrast, embodiments of the provided structure, apparatus, and systems can provide upper pins that are not all the same length and lower pins that are not all the same length.

As will be disclosed, the structure, apparatus, and systems can provide hot-plug capabilities to the NGFF module. Furthermore, embodiments providing a non-offset upper point of contact and a non-offset lower point of contact that are associated with the upper pins and the lower pins, respectively, can enable the NGFF module to be inserted in the NGFF connector without rotating and/or tilting the NGFF module relative to the plane of the NGFF connector.

An NGFF module is a memory device that incorporates memory and an edge connector (e.g., gold finger) on a removable component to a chassis. The NGFF module can be coupled to a NGFF connector on a carrier (e.g., chassis) by inserting the NGFF module into a NGFF connector. Coupling the NGFF module to the NGFF connector can include coupling an edge connector of the NGFF module to a number of lower and/or upper pins that are part of the NGFF connector. Coupling the NGFF module to the NGFF connector can give a computing device access to the memory that is associated with the NGFF module.

As used herein, hot-plugging an NGFF module into the NGFF connector is defined as establishing a connection between the NGFF connector and the NGFF module without interrupting an operation of the NGFF connector and/or the computing device that is coupled to the NGFF connector. Establishing a connection between the NGFF connector and the NGFF module includes connecting a plurality of GND pins to the NGFF module before connecting a plurality of PWR pins and a plurality of signal pins to the NGFF module. Establishing the connection between the NGFF connector and the NGFF module further includes connecting the plurality of PWR pins to the NGFF module before connecting the plurality of signal pins to the NGFF module.

FIG. 1 illustrates a diagram of an example of an apparatus according to the present disclosure. FIG. 1 includes carrier 106 (e.g., chassis). An NGFF connector 102 is located on the carrier 106. A printed circuit board (PCB) 104 can also be located on the carrier 106. According to a number of embodiments a sled 110 and a NGFF module 108 may be removably connected to the NGFF connector 102 on the carrier 106. FIG. 1 also includes arrow 112 which shows a removably connectable path that NGFF module 108 may take as NGFF module 108 is inserted into NGFF connector 102. The path, that is shown via arrow 112, that the NGFF module 108 may take as the NGFF module 108 is inserted into NGFF connector 102 is further defined in FIG. 2A and FIG. 2B.

As shown in FIG. 1, enclosure carrier 106 includes an NGFF connector 102 that is coupled to the PCB 104. The carrier 106 can receive a sled 110 that can include an integrated NGFF module 108.

As used herein, the carrier 106 is a case that houses the NGFF connector 102, the PCB 104 and/or the sled 110 that includes the NGFF module 108. The carrier 106 can house the NGFF connector 102 and the PCB 104 non-removably. That is, the NGFF connector 102 and the PCB 104 are intended to be decoupled and/or removed from the carrier 106. The NGFF module 108, however, can be decoupled and/or removed from for swapping and/or exchanging components.

The NGFF connector 102 can receive the NGFF module 108 and can communicate the content of the NGFF module 108 to a computing device via the enclosure PCB 104.

FIG. 1 also illustrates cut-line 2A and cut-line 2B. Cut-line 2A describes a cross sectional view of the NGFF connector 102 at a first depth in the NGFF connector 102. Cut-line 2B describes a cross sectional view of the NGFF connector 102 at a second depth in the NGFF connector 102.

Figure 2A:
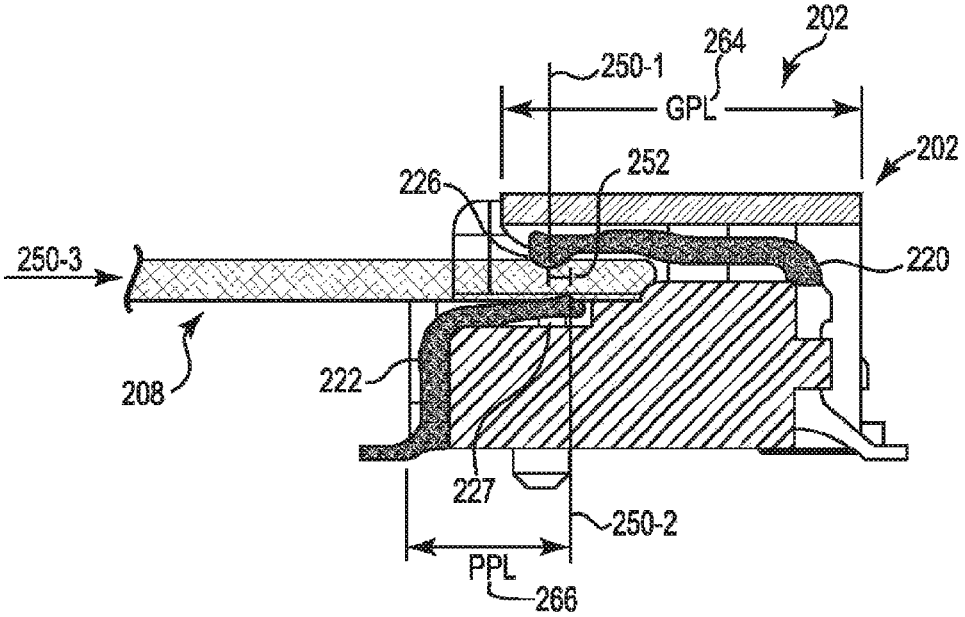
FIG. 2A illustrates a diagram taken along cut-line 2A in FIG. 1 of a cross sectional view along cut line 2A of an example of a Next Generation Form Factor (NGFF) connector according to the present disclosure.

FIG. 2A illustrates a diagram taken along cut-line 2A in FIG. 1 of a cross sectional view of an example of an NGFF connector 202 according to the present disclosure. As shown in FIG. 2A, the NGFF connector 202 includes a GND pin 220, a PWR pin 222, and an NGFF module 208 that is inserted in the NGFF connector 202. FIG. 2A also includes an upper point of contact 226 that is associated with the GND pin 220 and a lower point of contact 227 that is associated with the PWR pin 222.

While FIG. 2A only illustrates a single GND pin 220 and a single PWR pin 222, embodiments are not so limited. As such, the GND pin 220 represents the upper GND pins. As used herein, GND pin 220 is referred to as GND pins 220 to describe multiple GND pins. The PWR pin 222 represents the lower PWR pins. As used herein, PWR pin 222 is referred to as PWR pins 222 to describe multiple PWR pins. The GND pins 220 and the PWR pins 222 connect the NGFF module 208 to the NGFF connector 202. Additionally there may be an upper point of contact 226 and/or a lower point of contact 227 that can be referred to as upper points of contact 226 and lower points of contact 227, respectively, when describing multiple upper points of contact associated with GND pins 220 and/or multiple lower points of contact associated with PWR pins 222.

Figure 2B:
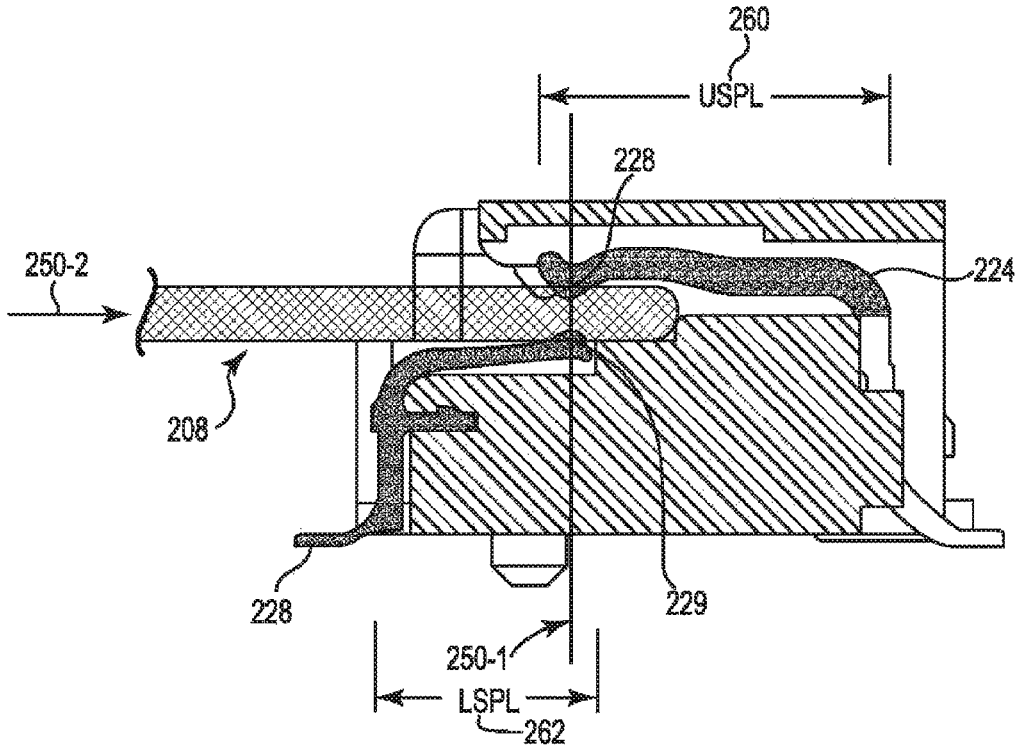
FIG. 2B illustrates a diagram taken along cut-line 2B in FIG. 1 of a cross sectional view of an example of an NGFF connector according to the present disclosure.

The length of the GND pins 220 is given as the GND pin length (GPL) 264 while the length of the upper signal pins 224 in FIG. 2B is given as the upper signal pin length (USPL) 260 in FIG. 2B. The length of the PWR pins 222 is given as the PWR pin length (PPL) 266 while the length of the lower signal pin 228 is given as the lower signal pin length (LSPL) 262 in FIG. 2B. As shown in the example of FIG. 2A, the GND pins 220 are longer than other upper pins (e.g., upper signal pins 224 in FIG. 2B). That is, the GPL 264 is greater than USPL 260. The PWR pins 222 are longer than other lower pins (e.g., lower signal pins 228 in FIG. 2B). That is, the PPL 266 is greater than LSPL 262. Having GND pins 220 that are longer than other upper pins (e.g., GPL 264>USPL 260) and PWR pins 222 that are longer than other lower pins (e.g., PPL 266>LSPL 262) provide the ability to removably connect (e.g., hot-plug) the NGFF module 208 to the NGFF connector 208 without disturbing the function of the NGFF connector 208 and/or the computing device by establishing a connection between the GND pins 220 and the PWR pins 222 and the NGFF module 208 before a connection is established between the other pins (e.g., upper signal pins 224 and lower signal pins 228) and the NGFF module 208. A connection between the GND pins 220 and the NGFF module 208 can be established before a connection is established between the other upper pins and the NGFF module 208 because the GND pins 220 are longer than the other upper pins. A connection between the PWR pins 222 and the NGFF module 208 can be established before a connection is established between the other lower pins and the NGFF module 208 because the PWR pins 222 are longer than the other lower pins. In a number of examples, a connection between the GND pins 220 and the NGFF module 208 can be established before a connection is established between the PWR pins 222 and the NGFF module 208. A connection between the PWR pins 222 and the NGFF module 208 can be established before a connection is established between the upper and/or lower signal pins (e.g., upper signal pins 224 and lower signal pins 228 in FIG. 2B).

The GND pins 220 and the PWR pins 222 can be coupled to the NGFF module 208 via an upper point of contact 226 and a lower point of contact 227, respectively. The upper points of contact 226 that are associated with the GND pins 220 and the lower points of contact 227 that are associated with the PWR pins 222 are on a plane perpendicular to a plane that is associated with each of the GND pins 220 and/or the PWR pins 222, respectively. For example, each of the GND pins 220 and/or PWR pins 222 are aligned along a plane (e.g., a horizontal plane) that goes from left to right and/or right to left as illustrated in FIG. 2A. The upper points of contact 226 that are associated with the GND pins 220 and/or the lower points of contact 227 that are associated with the PWR pins 222 are aligned on planes that go in and out of the illustration in FIG. 2A.

Planes that are associated with the upper points of contact 226 and/or the lower points of contact 227 can also be described in relation to the NGFF module 208. The length of the NGFF module 208 shown in FIG. 2B can create a plane 250-3 that is horizontal (e.g., left to right and/or right to left of the illustration in FIG. 2A). The upper points of contact 226 can be aligned on a first plane (e.g., a plane that goes in and/or out of the illustration in FIG. 2A) that is perpendicular to the horizontal plane 250-3 associated with the NGFF module 208. Furthermore, the lower points of contact 227 can be aligned on a second plane (e.g., a plane that goes in and/or out of the illustration in FIG. 2A) that is perpendicular to the horizontal plane 250-3 associated with the NGFF module 208.

The upper point of contact 226 that is associated with GND pin 220 is aligned on a vertical plane 250-1 (e.g., a plane that goes from the top to the bottom and/or the bottom to the top of the illustration in FIG. 2A). The lower point of contact 227 that is associated with an adjacent PWR signal pin 222 is aligned on a vertical plane 250-2 (e.g., a plane that goes from the top to the bottom and/or the bottom to the top of the illustration in FIG. 2A). Both the vertical plane 250-1 and the vertical plane 250-2 can be perpendicular to horizontal plane 250-3.

The vertical plane 250-1 and the vertical plane 250-2 are offset 252 along the horizontal plane 250-3. The vertical plane 250-1 that is associated with the upper point of contact 226 is not a same plane as vertical plane 250-2 that is associated with the lower point of contact 227. The upper point of contact 226 is offset from the lower point of contact 227 due to the upper points of contact 226 and the lower point of contact 227 not being aligned along a same vertical plane.

FIG. 2B illustrates a diagram taken along cut-line 2B in FIG. 1 of a cross sectional view of an example of an NGFF connector 202 according to the present disclosure. In the example given in FIG. 2B, an NGFF connector 202 includes an upper signal pin 224, a lower signal pin 2298, and an NGFF module 208 that is removably connected to the NGFF connector 202. The NGFF module 208 is analogous to the NGFF module 208 in FIG. 2A. FIG. 2B also includes an upper point of contact 228 that is associated with the upper signal pin 224 and a lower point of contact 229 that is associated with the lower signal pin 228.

While FIG. 2B only illustrates a single upper signal pin 224 and a single lower signal pin 226, embodiments are not so limited. As such, the upper signal pin 224 represents upper pins that are not GND pins and/or PWR pins. As used herein, upper signal pin 224 is referred to as upper signal pins 224 when referring to multiple upper signal pins. The lower signal pin 228 represents lower pins that are not GND and/or PWR pins. As used herein, the lower signal pin 228 is referred to as lower signal pins 228 when referring to multiple lower signal pins. The upper signal pins 224 and the lower signal pins 224 connect the NGFF module 208 to the NGFF connector 202 along with the GND pins 220 and the PWR pins 222 in FIG. 2A.

The length of the upper signal pin 224 is given as the upper signal pin length (USPL 260) and the length of the GND pin is given as GND pin length (GPL) 264 in FIG. 2B. The length of the lower signal pin 224 is given as the lower signal pin length (LSPL 262) and the length of the PWR pin is given as PWR pin length (PPL) 266 in FIG. 2B. In a number of examples, the upper signal pins 224 and the lower signal pins 228 are shorter than GND pins 220 and the PWR pins 222, respectively. For example, the USPL 260 is less than the GPL 264 and the LSPL 262 is less than the PPL 266. Having upper signal pins 224 and lower signal pins 228 that are shorter than the GND pins 220 and PWR pins 222 (e.g., USPL 260<GPL 264 and LSPL 262<PPL 266), respectively, further provide the ability to removably connect the NGFF module 208 to the NGFF connector 208 without disturbing the NGFF connector 208 and/or an associated computing device by establishing a connection between the upper signal pins 224 and the lower signal pins 228 and the NGFF module 208 after a connection is made between the GND pins 220 and/or the PWR pins 222 and the NGFF module 208.

The upper signal pins 224 and the lower signal pins 228 can be coupled to the NGFF module 208 via an upper point of contact 228 and a lower point of contact 229, respectively. The upper points of contact 228 that are associated with the upper signal pins 224 and the lower points of contact 229 that are associated with the lower signal pins 228 are aligned on a plane perpendicular to a plane associated with each the upper signal pins 224 and/or the lower signal pins 228, respectively.

For example, each of the upper signal pins 224 and/or lower signal pins 228 are aligned along a plane (e.g., horizontal plane) that goes from left to right and/or right to left as illustrated in FIG. 2B. The upper points of contact 228 that are associated with the upper signal pins 220 and/or the lower points of contact 229 that are associated with the lower signal pins 228 are aligned on planes that go in and out of the illustration in FIG. 2B.

Planes that are associated with the upper points of contact 228 and/or the lower points of contact 229 can also be described in relation to the NGFF module 208. The length of the NGFF module 208 shown in FIG. 2B can create a plane 250-2 that is horizontal (e.g., left to right and/or right to left of the illustration in FIG. 2B). The upper points of contact 228 can be aligned on a first plane (e.g., a plane that goes in and/or out of the illustration in FIG. 2B) that is perpendicular to the horizontal plane 250-2 associated with the NGFF module 208. Furthermore, the lower points of contact 229 can be aligned on a second plane (e.g., a plane that goes in and/or out of the illustration in FIG. 2B) that is perpendicular to the horizontal plane 250-2 associated with the NGFF module 208.

The upper point of contact 228 associated with an upper signal pin 224 and the lower point of contact 229 associated with an adjacent lower signal pin 224 are aligned on a vertical plane 250-1 (e.g., a plane that goes from the top to the bottom and/or the bottom to the top of the illustration in FIG. 2B) that is perpendicular to horizontal plane 250-2. That is, there is not offset between the upper point of contact 228 and the lower point of contact 229 along a horizontal plane 250-2 that is perpendicular to vertical plane 250-1.

Plane 250-2 further describes a path that is taken to insert NGFF module 208 into NGFF connector 202. The NGFF module 208 is inserted into the NGFF connector 202 without tilting and/or rotating the NGFF module 208. The NGFF module 208 can be inserted into the NGFF connector 202 along plane 250-2 because there is no offset between the upper point of contact 226-1 and the lower point of contact 226-2.

An offset can require a tilt and/or rotation of the NGFF module 208 to insert the NGFF module 208 into the NGFF connector 202 to alleviate the strain placed on the NGFF connector 202 pins. However, the lack of an offset between the upper points of contact 228 and the lower points of contact 229 provide the ability to insert the NGFF module 208 into the NGFF connector 202 without tilting and/or rotating the NGFF module 208 due to an equal strain being placed on the upper signal pin 224 and the lower signal pin 228.

Figure 3:
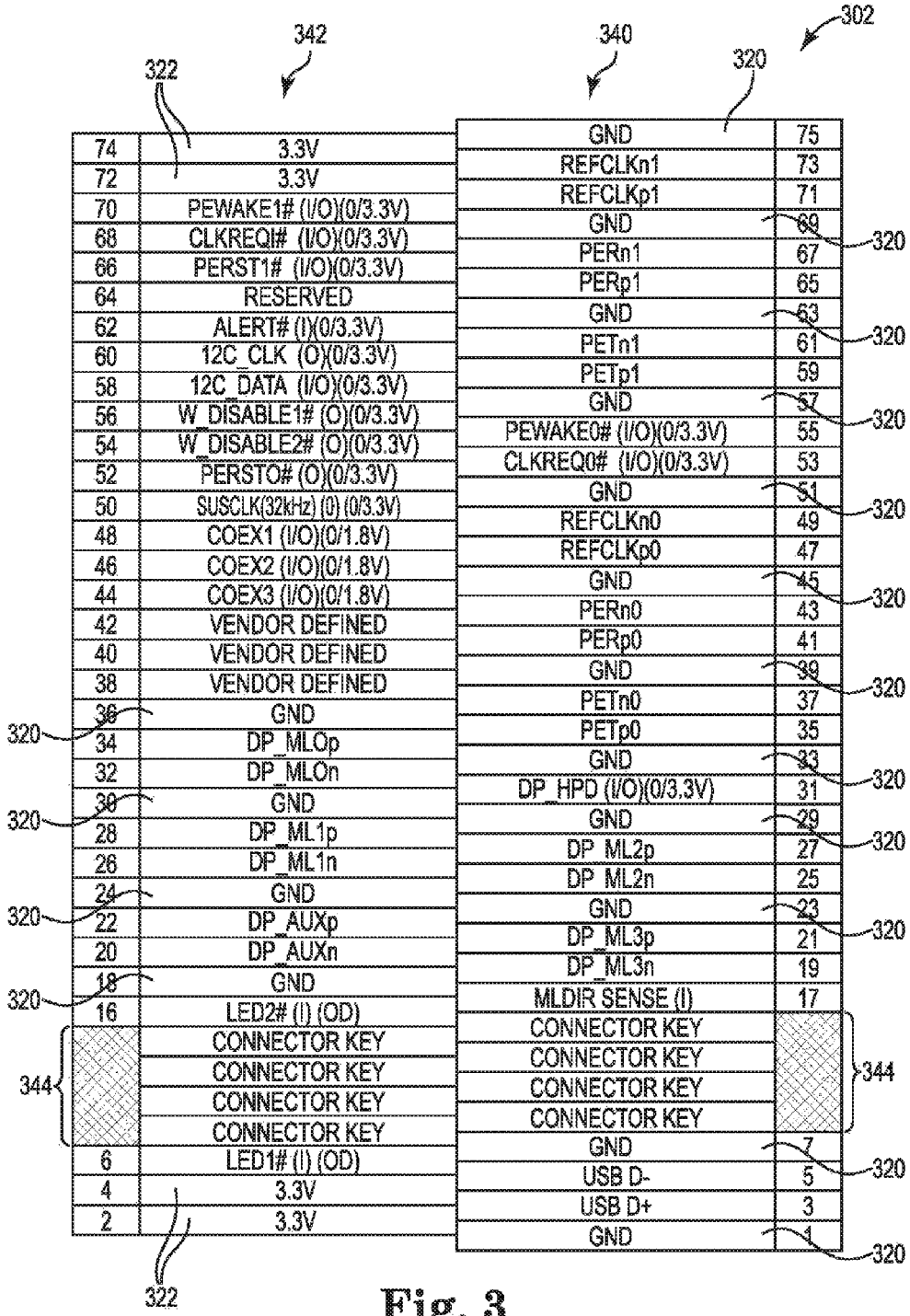
FIG. 3 illustrates a diagram of an example of a number of pins according to the present disclosure.

FIG. 3 illustrates a diagram of an example of a number of pins according to the present disclosure. FIG. 3 includes an illustration of the upper pins 340 and the lower pins 342 of NGFF connector 302. FIG. 3 also include the GND pins 320, the PWR pins 322, and the signal pins.

The upper pins 340 of NGFF connector 302 are labeled as the odd pins ranging from pin 1 to 7 and 17-75. The lower pins of the NGFF connector 302 are labels as the even pins ranging from pin 2 to 6 and 16 to 74.

The NGFF connector 302 can be configured with a connector key. The connector key is a barrier in place of pins 8 to 15. As such, there are no pins ranging from 8 to 15. The NGFF connector 302 can be configured with a connector key that spans a different pin structure. That is, the connector key can take the place of different pins than those outlined herein.

The upper pins 340 of NGFF connector 302 can include GND pins 320. The GND pins 320 can include pins 1, 7, 23, 29, 33, 39, 45, 51, 57, 63, 69, and 75. All other upper pins 340 (e.g., pins 3, 5, 17, 19, 21, 25, 27, 31, 35, 37, 41, 43, 47, 49, 53, 55, 59, 61, 65, 67, 71, 73, and 75) can be upper signal pins. The lower pins 342 of NGFF connector 302 can include PWR pins 322 and GND pins 320. The PWR pins 322 can include pins 2, 4, 72, and 74. The lower GND pins 320 can include pins 18, 24, 30, 36. All other lower pins 342 that are not PWR pins 322 and/or GND pins 320 are signal pins. FIG. 3 includes a description of the upper and lower signal pins in an example of the pin functions.

The example given of the pin structure associated with the upper pins 340 and the lower pins 342 is demonstrative and not limiting. Other configurations of the PWR pins, GND pins, and/or signal pins can be used in association with a connector key 344. For example, a pin 75 that is a GND pin 320 in FIG. 3 can be a signal pin in a different example.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. Further, as used herein, "a number of" an element and/or feature can refer to one or more of such elements and/or features.

As used herein, "logic" is an alternative or additional processing resource to perform a particular action and/or function, etc., described herein, which includes hardware, e.g., various forms of transistor logic, application specific integrated circuits (ASICs), etc., as opposed to computer executable instructions, e.g., software firmware, etc., stored in memory and executable by a processor.

What is claimed:

1. An apparatus, comprising:

a Next Generation Form Factor (NGFF) connector comprising:

a plurality of first side signal pins;

a first side ground (GND) pin that is longer than other first side pins and that has a first point of contact to make a first connection;

a plurality of second side signal pins; and a second side power (PWR) pin that is longer than other second side pins and that has a second point of contact that is offset from the first point of contact along a first plane perpendicular to the plurality of first side signal pins and the first side GND pin to make a second connection after the first connection.

2. The apparatus of claim 1, wherein a second side point of contact associated with the plurality of second side signal pins is on a second plane perpendicular to the plurality of second side signal pins.

3. The apparatus of claim 2, wherein a first side point of contact associated with the plurality of first side signal pins is on a third plane perpendicular to the plurality of first side signal pins.

4. The apparatus of claim 3, wherein the second plane perpendicular to the plurality of first side signal pins is a same plane as the third plane perpendicular to the plurality of second side signal pins.

5. The apparatus of claim 4, wherein the second side point of contact associated with the plurality of second side signal pins and the first side point of contact associated with the plurality of first side signal pins enable an NGFF module to be inserted in the NGFF connector along a fourth plane perpendicular to the same plane.

6. The apparatus of claim 5, wherein the second side point of contact associated with the plurality of second side signal pins and the first side point of contact associated with the plurality of first side signal pins enable the connection between the NGFF connector and the NGFF module to be established without rotating or tilting the NGFF module relative to the fourth plane associated with the NGFF connector.

7. The apparatus of claim 1, wherein a plane perpendicular to the second point of contact associated with the second side PWR pin is not a same plane as a plane perpendicular to the first point of contact associated with the GND pin.

8. A system, comprising:

a carrier;

a printed circuit board (PCB) located on the carrier;

a Next Generation Form Factor (NGFF) connector fixedly connected to the PCB, the NGFF connector comprising:

a plurality of first side signal pins;

a plurality of first side ground (GND) pins that are longer than other first side pins and that have a first plurality of point of contacts to make a first plurality of connections;

a plurality of second side signal pins; and a plurality of second side power (PWR) pins that are longer than other second side pins and that have a second plurality of point of contacts that are offset from the first plurality of point of contacts along a plane perpendicular to the plurality of first side signal pins and the first side GND pin to make a second plurality of connections after the first plurality of connections.

9. The system of claim 8, wherein the PCB is coupled to a driver connector.

10. The system of claim 9, wherein the driver connector is coupled to a backplane.

11. The system of claim 10, wherein the NGFF connector is fixedly coupled to the PCB.

12. An apparatus, comprising:

a Next Generation Form Factor (NGFF) connector comprising:

a plurality of first side signal pins;

a plurality of first side ground (GND) pins that are longer than other first side pins and that have a first plurality of point of contacts;

a plurality of second side signal pins;

a plurality of second side power (PWR) pins that are longer than other second side pins that have a second plurality of point of contacts that are offset from the first plurality of point of contacts along a plane perpendicular to the plurality of first side signal pins and the first side GND pin; and wherein an NGFF module is removably connected to the NGFF connector.

13. The apparatus of claim 12, wherein a structure of the plurality of GND pins and the plurality of PWR pins allows a connection to be established between the NGFF connector and an NGFF module without interrupting an operation of the NGFF connector.

14. The apparatus of claim 13, wherein the structure of the plurality of GND pins and the plurality of PWR pins allows the plurality of GND pins to be connected to the NGFF module before a connection is established between the plurality of PWR pins and the NGFF module and a connection is established between the plurality of signal pins to the NGFF module.

15. The apparatus of claim 14, wherein a structure of the plurality of PWR pins and the plurality of signal pins allows the plurality of PWR pins to be connected to the NGFF module before a connection is established between the plurality of signal pins and the NGFF module.

* * * * *